US005713524A

United States Patent [19]

Greene et al.

[11] Patent Number: 5,713,524

[45] Date of Patent: Feb. 3, 1998

[54] PLASTIC LINED FIRE PROTECTION SYSTEM

[75] Inventors: Wallace Greene; Bernd Schulte-Ladbeck, both of Houston, Tex.

[73] Assignee: Performance Plastics Products, Inc., Houston, Tex.

[21] Appl. No.: 576,157

[22] Filed: Dec. 21, 1995

[51] Int. Cl.[6] ..... B05B 1/00

[52] U.S. Cl. ..... 239/596; 169/37

[58] Field of Search ..... 239/207, 209, 239/266, 267, 368, 566, 567, 589, 596; 285/55; 169/16, 37, 41; 138/46

[56] References Cited

U.S. PATENT DOCUMENTS

| | | | |
|---|---|---|---|
| 4,281,859 | 8/1981 | Davies | 285/55 |
| 4,643,457 | 2/1987 | Press | 285/55 |
| 4,791,993 | 12/1988 | Curran | 239/209 X |
| 5,152,323 | 10/1992 | Shotts et al. | 138/151 |
| 5,277,455 | 1/1994 | Graves et al. | 285/55 |
| 5,326,468 | 7/1994 | Cox | 138/46 X |

*Primary Examiner*—Andres Kashnikow
*Assistant Examiner*—Steven J. Ganey
*Attorney, Agent, or Firm*—Conley, Rose & Tayon, P.C.

[57] ABSTRACT

An improved fire protection system which incorporates delivery conduits having an inner liner, preferably formed of plastic. Attachment of the nozzle assemblies to the conduit is made at the flanged end of a piping segment and, preferably, at the connection points between two piping segments. The connection is formed so that water is communicated from within the conduits to the sprinkler head while avoiding contact with metal surfaces of the conduits. A spacer assembly is provided which is placed between the ends of two flanged piping segments. The spacer assembly includes an inner plastic disk and outer annular fire protection ring. A lateral port is disposed through both the ring and disk and preferably threaded for the attachment of a nozzle or other dispensing means. The spacer assembly forms a metal to metal seal with both piping segments for fire protection. Either lateral edge of the fire protection ring may be crimped or crushed slightly to aid in forming this seal.

17 Claims, 2 Drawing Sheets

PLASTIC LINED FIRE PROTECTION SYSTEM

BACKGROUND OF THE INVENTION

1. Field of the Invention

The present invention relates generally to industrial-type fire protection systems and the protection of such systems.

2. Description of Related Art

Most contemporary buildings and facilities contain fire protection systems which, very generally, include a source for water or other fire fighting substance, delivery pipes or conduits, and spray nozzles. Water-dispensing systems are among the most common because water is inexpensive and easily replaceable. Typically, the water is maintained in the system under pressure so that it may be easily released in the event of a fire or, at least the system is pressure-tested periodically during its service life. Unfortunately, the pressurization causes at least some of the water to intrude into the pipes or conducts where it will stand. Because of the need for a fire protection system to be rugged and resistant to damage, the system's delivery conduits are typically formed of a sturdy metal such as steel, but, in some cases, may be made of copper alloys or other metals.

Prolonged contact between the water and metal in the delivery conduits is undesirable. If water remains standing in the delivery pipes for a significant amount of time, there is a risk of deterioration in the system through oxidation. Facilities in some areas of the country, such as Phoenix, Ariz. and some locations in Louisiana, California and New England, have experienced additional problems where surface water is used in the fire protection system. Microbes introduced through organic matter in the surface water have caused rapid deterioration of the steel in the pipes where water has been standing.

Fire protection systems of this type are also vulnerable to deterioration of this nature, particularly at the connection of the spray nozzle to the conduit. Typically, a lateral hole is drilled into the pipe at some point along its length. The hole is then threaded and a fitting is attached which either includes or is connected to a spray nozzle. Because the nozzle assembly becomes affixed to the conduit at a point along its length, the water is communicated through the wall of the conduit, resulting in a potential leak point. Applicant is unaware of any instance in which a fire protection system has been provided with conduits which have been either lined or coated with a protective substance. However, if such a system were used, attachment of nozzle assemblies at points along the length of the conduit in this manner might result in water being able to intrude between the lining or coating and the inner pipe surface at the connection point.

SUMMARY OF THE INVENTION

The present invention provides an improved fire protection system which incorporates delivery conduits having an inner liner, preferably formed of plastic. Attachment of the nozzle assemblies to the conduit is made at the flanged end of a piping segment and, preferably, at the connection points between two piping segments. The connection is formed so that water is communicated from within the conduits to the sprinkler head while avoiding contact with metal surfaces of the conduits.

A spacer assembly is provided which is placed between the ends of two flanged piping segments. The spacer assembly includes an inner plastic disk and outer annular fire protection ring. A lateral port is disposed through both the ring and disk and preferably threaded for the attachment of a nozzle or other dispensing means. The spacer assembly forms a metal to metal seal with both piping segments for fire protection. Either lateral edge of the fire protection ring may be crimped or crushed slightly to aid in forming this seal.

BRIEF DESCRIPTION OF THE DRAWINGS

Other features and intended advantages of the invention will be more readily apparent by reference to the following detailed description in connection with the accompanying drawings, wherein.

DESCRIPTION OF THE PREFERRED EMBODIMENTS

Figure 1:
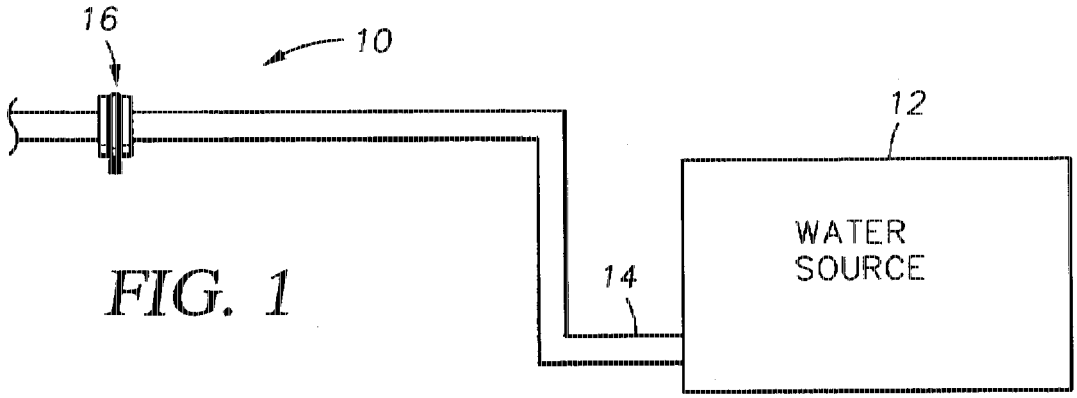
FIG. 1 is a schematic representation of an exemplary fire protection system.

FIG. 1 shows a simplified schematic illustration of an exemplary water-based fire protection system 10 which includes a water source 12, a delivery conduit 14, and a distribution nozzle assembly 16. Those skilled in the art will understand that there may be a plurality of delivery conduits 14 and distribution nozzle assemblies 16 in an actual system. In typical systems, the water source 12 and delivery conduits 14 are concealed with only the delivery nozzle assemblies 16 being open to view. It is noted that no particular brand or type of nozzle is required by the present invention. Indeed, a "nozzle," per se, is not required. Any device or fixture used for dispensing water or other fluids for the purposes of extinguishing fires is intended to be included.

Figure 2:
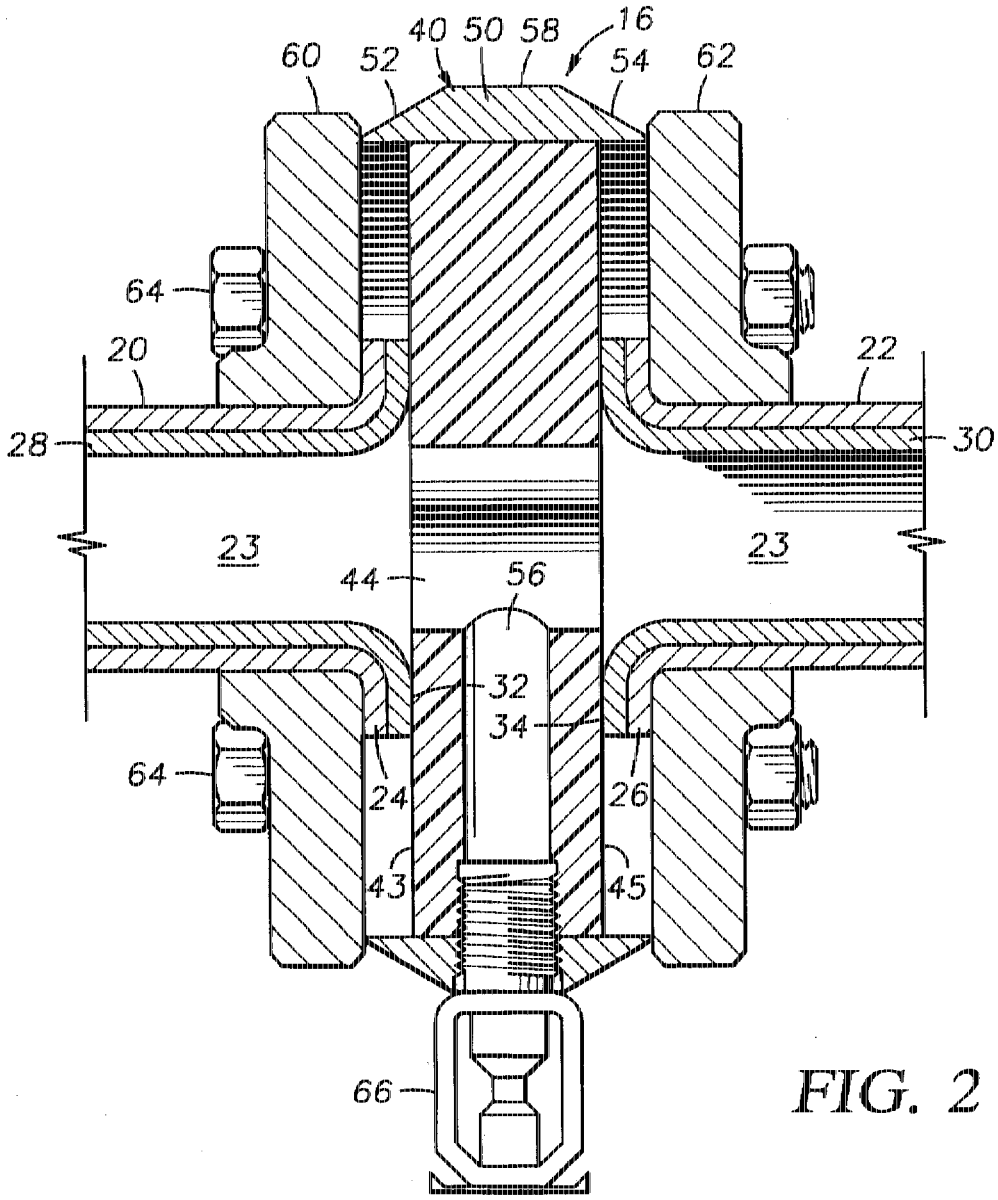
FIG. 2 is a cross-sectional view of an exemplary nozzle assembly constructed in accordance with the present invention.

A close-up of the portion of the system surrounding the delivery nozzle assembly 16 is shown in FIG. 2. As shown, an exemplary nozzle assembly 16 is located at the ends of two piping segments 20, 22, which are positioned coaxially with respect to one another and define a central fluid passageway 23. Each of the piping segments 20, 22 include a flanged end 24, 26. Each piping segment 20, 22 is lined with an inner plastic liner 28, 30. The liner is typically formed of a corrosion-resistant resin of a type known in the art. In a preferred embodiment, the plastic liners 28, 30 comprise polytetrafluoroethylene (PTFE). Liners may also be used which are made of perfluoro alkoxyalkane (PFA), perfluro ethylene propylene (FEP), polyvinylidene fluoride (PVDF), and polypropyline (PP). Each plastic liner 28, 30 is flared at its end to provide a plastic liner axial flange face 32, 34.

Figure 4:
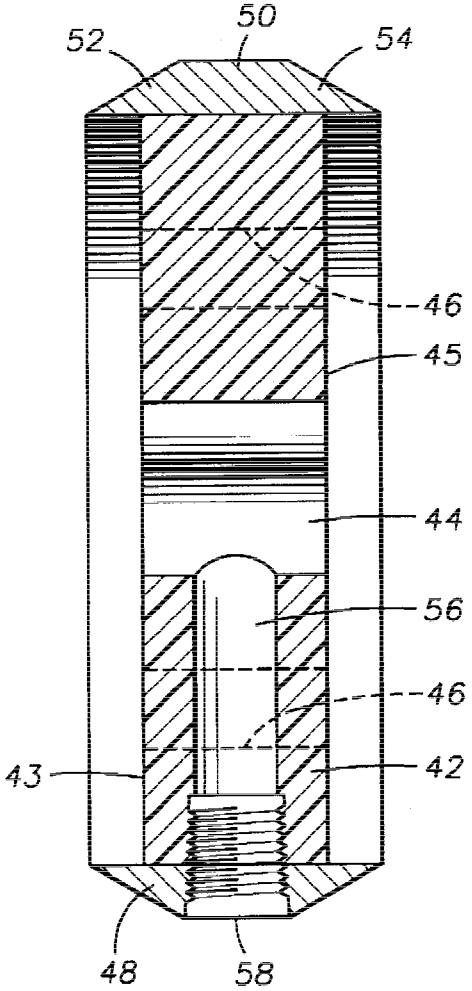
FIG. 4 is a cross-sectional view of the spacer of FIG. 3.
Figure 3:
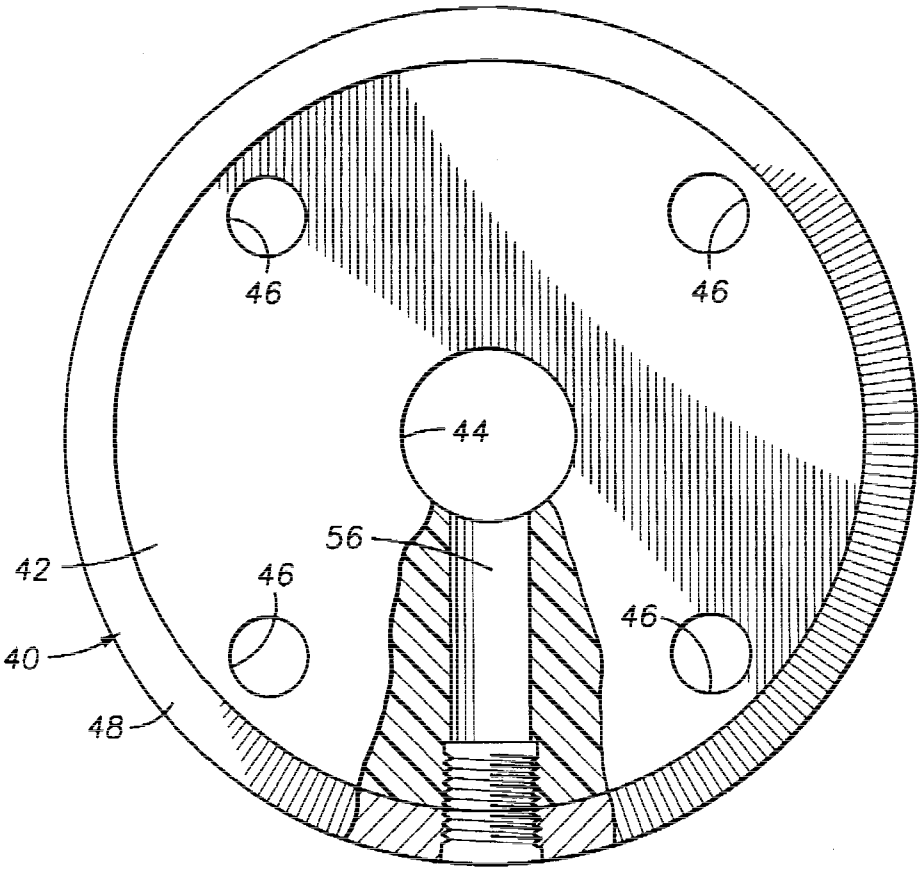
FIG. 3 is an end view of an exemplary spacer in accordance with the present invention.

The nozzle assembly 16 features a spacer 40 which is shown in further detail in FIGS. 3 and 4. The spacer 40 features an inner plastic disk 42 which is preferably formed of Teflon®. Other plastics or corrosion-resistant resins, such as those described earlier with respect to the plastic liners 28, 30, may also be used to form the disk 42. The disk 42 presents axial side surfaces 43, 45 and a central aperture 44 and a plurality of bolt holes 46 which are disposed axially through the disk.

The inner disk 42 is surrounded radially by an outer annular ring 48 which is formed of steel or another type of metal, and which is significantly resistant to degradation by fire or other hazards. As shown in the cross-sectional views of FIGS. 2 and 4, the steel reinforcing ring 48 presents a cross-sectional area which generally includes a central rectangular section 50 and two axial triangular edge sections 52 and 54.

A lateral fluid communication port 56 is disposed through the spacer 40 so as to permit fluid communication from the central aperture 44 to the outer radial edge 58 of the spacer 40. Preferably, the lateral port 56 is threaded proximate the outer radial edge 58. It is noted that both portions of the steel reinforcing ring 48 and the inner disk 42 are threaded.

As FIG. 2 shows, a pair of lap flanges 60, 62 are positioned along either piping segment 20, 22 which contact the ranged ends 24, 26 to ensure a secure joining and connection by the nozzle assembly 16 and by one or more bolts and nuts 64 which are disposed through the bolt holes 46 of the spacer 40 and lap flanges 60, 62.

A spray nozzle 66 or other distribution fitting is affixed to the spacer 40 by threaded insertion into the lateral port 56.

As the bolts and nuts 64 are tightened during assembly of the connection, it is pointed out that the axial edges 52, 54 of the steel reinforcing ring 48 form a metal-to-metal seal with the lap flanges 60, 62. It is preferred that the metal-to-metal seal be insured through a tightening of the bolts and nuts 64 sufficient to cause a crimping or crushing of portions of the lateral edges 52, 54 of the reinforcing ring 48. In addition, the plastic flange faces 32, 34 of either piping segment 20, 22 form a plastic-to-plastic seal with the axial side surfaces 32, 34 of the inner disk 42 of the spacer 40.

In operation, the water or other fluid will be maintained within the central fluid passageway 23 of the piping segments 20, 22.

The water is transmitted from the central passageway 23 to nozzle 66 through the lateral port 56 without contact with metal surfaces. Thus, deterioration of the metallic portions of the delivery conduits is prevented.

It will be apparent to those skilled in the art that many modifications may be made to the construction and arrangement of parts herein described without departing from the spirit and scope of the invention. For example, it should be understood that the piping segments 20, 22 discussed are not limited to conventional straight runs of piping, but also include curved sections and fitting such as Tees, elbows, reducers, and other conventional or unconventional piping designs. Also, if a nozzle assembly is located at the end of a delivery conduit run, one of the piping segments 20 or 22 might be replaced with a flat end plate. While the invention has been described with respect to certain preferred embodiments, it should be understood that the inventive concepts disclosed herein are intended to be limited only by the following claims.

What is claimed is:

1. A fire protection system comprising:

a water supply source;

a delivery conduit formed of at least one flanged, plastic-lined piping segment; and a nozzle assembly affixed to the flanged end of the piping segment, the nozzle assembly comprising:

a spacer having an outer radial edge to which a nozzle may be affixed and an axial face to adjoin and be affixed to the flanged end of the piping segment.

2. The system of claim 1 wherein the spacer further comprises an inner disk substantially formed of plastic and an outer annular ring substantially formed of a fire resistant material.

3. A nozzle assembly for use in a fire protection system comprising:

a nozzle assembly spacer comprising an inner disk substantially formed of plastic and an outer annular ring substantially formed of a fire resistant material;

a nozzle affixed to said spacer;

a central aperture disposed through the disk proximate its center; and a lateral fluid communication port disposed through the spacer from the outer radial edge of the spacer to the central aperture.

4. The nozzle assembly of claim 3 wherein the outer annular ring presents a cross- section having a central rectangle and two lateral edge sections of triangular shape.

5. The nozzle assembly of claim 3 wherein the plastic which substantially forms the inner disk comprises Teflon®.

6. The nozzle assembly of claim 3 wherein the lateral fluid communication port is threaded for affixation of a nozzle.

7. The nozzle assembly of claim 3 wherein the fire resistant material substantially forming the outer annular ring comprises steel.

8. A fire protection system comprising:

a) a water supply source;

b) a nozzle assembly for dispensing of water from said water supply source, the nozzle assembly comprising a generally disk-shaped spacer and a nozzle affixed to an outer radial edge of said spacer; and c) a delivery conduit interconnecting the water supply source with the and communicating water from the water supply source to the nozzle, said delivery conduit comprising a plurality of coaxially interconnected plastic lined piping segments which define a central fluid passageway.

9. The fire protection system of claim 8 wherein the disk-shaped spacer of said nozzle assembly comprises an inner plastic disk and an outer annular ring.

10. The fire protection system of claim 9 wherein the inner plastic disk is substantially comprised of polytetrafluoroethylene.

11. The fire protection system of claim 9 wherein the inner plastic disk is substantially comprised of perfluoro alkoxyalkane.

12. The fire protection system of claim 9 wherein the inner plastic disk is substantially comprised of perfluoro ethylene propylene.

13. The fire protection system of claim 9 wherein the inner plastic disk is substantially comprised of polyvinylidene fluoride.

14. The fire protection system of claim 9 wherein the inner plastic disk is substantially comprised of polypropylene.

15. The fire protection system of claim 8 wherein said plastic-lined piping segments have flanged ends.

16. The fire protection system of claim 15 wherein the nozzle assembly is disposed between the ranged ends of two coaxially interconnected plastic-lined piping segments.

17. The fire protection system of claim 16 further comprising a lap flange contacting said flanged ends.

* * * * *